United States Patent [19]

Mode

[11] 4,317,518

[45] Mar. 2, 1982

[54] CARTON WITH RECLOSABLE SPOUT AND BLANK THEREFOR

[75] Inventor: Duane R. Mode, Edina, Minn.

[73] Assignee: Champion International Corporation, Stamford, Conn.

[21] Appl. No.: 184,092

[22] Filed: Sep. 4, 1980

[51] Int. Cl.[3] ..... B65D 5/74; B65D 5/70

[52] U.S. Cl. ..... 206/626; 206/612; 229/17 R

[58] Field of Search ..... 206/626, 612; 226/17 R, 226/7 R

[56] References Cited

U.S. PATENT DOCUMENTS

| | | | |
|---|---|---|---|
| 2,364,439 | 12/1944 | Guyer | 229/17 R |
| 2,488,323 | 11/1949 | Parker | 229/17 R |
| 2,819,831 | 1/1958 | Polarek et al. | 229/17 R |
| 3,133,689 | 5/1964 | Rossi | 229/17 R |
| 3,521,809 | 7/1970 | Zimmerman | 229/17 R |

*Primary Examiner*—Stephen P. Garbe
*Attorney, Agent, or Firm*—Evelyn M. Sommer

[57] ABSTRACT

A paperboard carton and blank therefor having a reclosable spout. The spout includes a main spout member and a secondary spout member. The main spout member is defined by a fold line, first and second tear-away members extending from the fold line and a third tear-away member interconnecting the first and second tear-away members. The secondary spout member is defined by a second fold line and the third tear-away member. Each tear-away member is formed from two cut lines, one on the exterior surface of the paperboard and the other on the interior surface, neither penetrating the full thickness of the paperboard. After the tear-away members are torn-away, the secondary spout member is overlapped onto the exterior of the main spout member to reclose the spout.

14 Claims, 11 Drawing Figures

FIG. 1
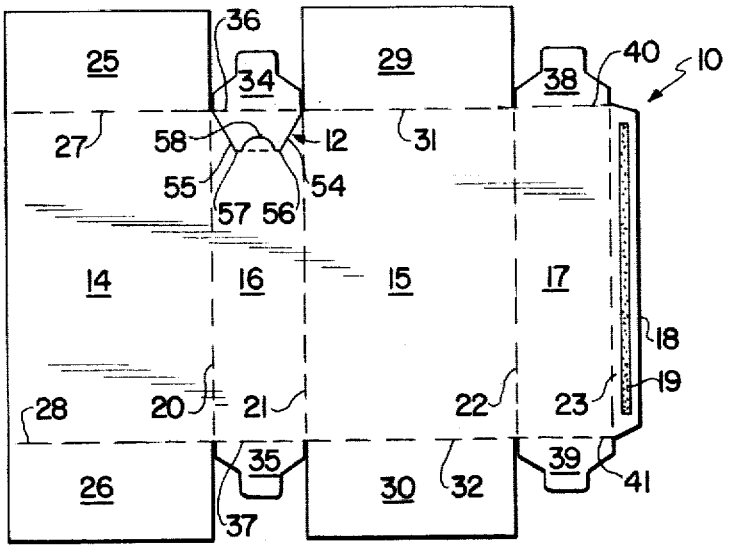
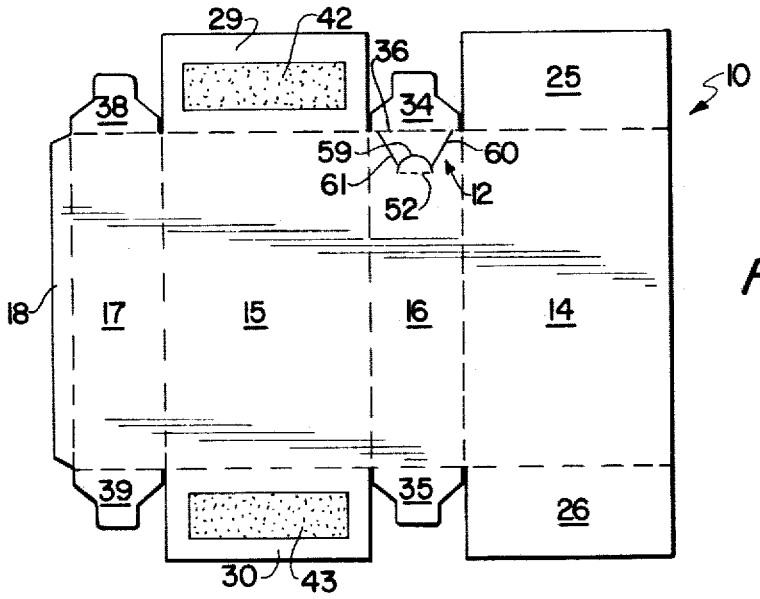
FIG. 2
FIG. 3
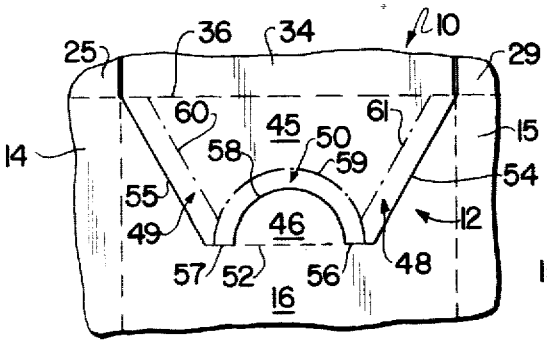
FIG. 4
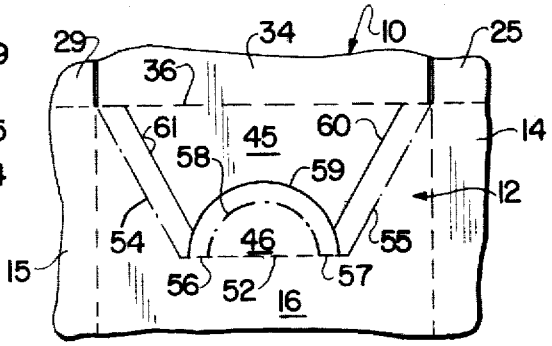

CARTON WITH RECLOSABLE SPOUT AND BLANK THEREFOR

FIELD OF THE INVENTION

The present invention relates to a paperboard carton and blank therefor having a reclosable spout. The spout includes a main spout member and a secondary spout member which are hingedly coupled along two fold lines to a panel. A tearaway member defines the bottom of the main spout member and the top of the secondary spout member.

BACKGROUND OF THE INVENTION

Many prior art paperboard cartons disclose spout assemblies for pouring the contents from the carton. However, many of these prior art spout assemblies are unsightly, expensive to fabricate and difficult to manipulate. Some also include metallic parts which greatly add to the cost of manufacture. In addition, many of these prior art spout assemblies open in an inward direction and therefore can interfere with the outward flow of the contents. Finally, many of these prior art spout assemblies cannot easily and securely be reclosed so that the contents of the carton can easily become contaminated or inadvertently spilled therefrom.

SUMMARY OF THE INVENTION

Accordingly, a primary object of the present invention is to provide a paperboard carton and blank therefore with a reclosable spout which is simple, inexpensive to manufacture and easily opened and reclosed.

Another object of the present invention is to provide such a carton and blank therefor which has an outwardly opening spout which is also neat in appearance.

The foregoing objects are basically attained by providing a carton formed of paperboard having a reclosable spout comprising a plurality of panels hingedly coupled along fold lines and arranged as a closed tubular body, one of the panels including a main spout member and a secondary spout member, the main spout member being defined by a first fold line, first and second tear-away members extending from the first fold line and a third tear-away member interconnecting the first and second tear-away members, the secondary spout member being defined by a second fold line and the third tear-away member, the third tear-away member being formed from a pair of spaced cut lines, one of the cut lines being formed on the exterior surface of the panel and the other of the cut lines being formed on the interior surface of the panel, each of the cut lines extending a depth into the panel less than the thickness of the panel.

The foregoing objects are also basically attained by providing a blank for a paperboard carton having a reclosable spout comprising a plurality of panels hingedly coupled in series along fold lines, one of the panels including a first fold line, first and second cut lines extending from the first fold line and formed in the exterior surface of the panel and extending a depth into the panel less than the thickness of the panel, third and fourth cut lines extending from the first and second cut lines and formed in the exterior surface of the panel and extending a depth into the panel less than the thickness of the panel, a fifth cut line interconnecting the third and fourth cut lines and formed in the exterior surface of the panel and extending a depth into the panel less than the thickness of the panel, a second fold line extending between the third and fourth cut lines, a sixth cut line formed in the interior surface of the panel and extending a depth into the panel less than the thickness of the panel, the sixth cut line extending from a location adjacent the third cut line to a location adjacent the fourth cut line and being spaced from the fifth cut line, and seventh and eighth cut lines formed in the interior surface of the panel and extending a depth into the panel less than the thickness of the panel, the seventh and eighth cut lines extending from the first fold line into an intersection with the sixth cut line and being spaced from the first and second cut lines.

Other objects, advantages and salient features of the present invention will become apparent from the following detailed description, which, taken in conjunction with the annexed drawings, discloses a preferred embodiment of the present invention.

DRAWINGS

Referring now to the drawings which form a part of this original disclosure:

FIG. 1 is a top plan view of the exterior surface of the blank in accordance with the present invention showing on the exterior surface the visible fold and cut lines forming the reclosable spout of the present invention;

FIG. 2 is a bottom plan view of the blank shown in FIG. 1, thereby showing the interior surface of the blank in accordance with the present invention and showing the fold and cut lines forming the spout as visible on the interior surface of the blank;

FIG. 3 is a fragmentary, enlarged top plan view of the spout shown in FIG. 1 where the dotted lines represent fold lines, the solid lines represent cut lines on the exterior surface of the blank and the phantom lines represent cut lines on the interior surface of the blank;

FIG. 4 is a fragmentary enlarged bottom plan view of the portion of the blank shown in FIG. 3 in which the dotted lines represent fold lines, the solid lines represent cut lines on the interior surface of the blank and the phantom lines represent cut lines on the exterior surface of the blank;

Figure 8:
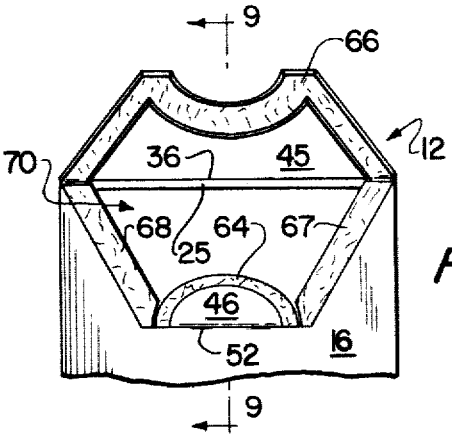
FIG. 8 is a fragmentary, enlarged side elevational view of the spout shown in FIG. 6 in which the main spout member has been pulled outwardly of the carton and pivoted upwardly, thereby opening the spout orifice.
Figure 10:
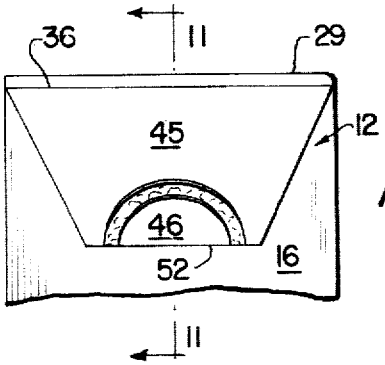
Figure 11:
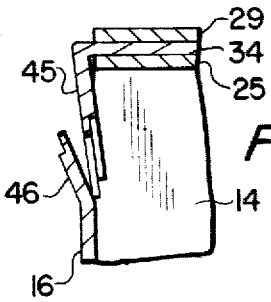

FIG. 10 is a fragmentary, enlarged side elevational view of the spout reclosed from the position shown in FIG. 8 by first folding the secondary spout member outwardly, then folding the main spout member back to its initial position and then allowing the secondary spout member to resume its unfolded position and maintain the main spout member in a reclosed position by means of the memory of the folded paperboard forming the secondary spout member; and FIG. 11 is a cross-sectional view taken along lines 11—11 in FIG. 10.

DETAILED DESCRIPTION OF THE INVENTION

Referring now to FIGS. 1-4, the blank 10 formed of thin, foldable and cutable paperboard is shown having the reclosable spout 12 in accordance with the present invention defined thereon. FIG. 1 shows the exterior of the blank, which becomes the exterior of the carton, while FIG. 2 shows the interior of the blank which becomes the interior of the carton.

The blank 10 is comprised of a plurality of panels hingedly coupled in series along fold lines including two major panels 14 and 15, two minor panels 16 and 17 and a glue flap 18 having adhesive 19 thereon. A series of parallel fold lines 20, 21, 22 and 23 are respectively formed between panels 14 and 16, panels 16 and 15, panels 15 and 17 and panel 17 and glue flap 18. Each of the major and minor panels 14-17 are substantially rectangular.

Two rectangular major closure flaps 25 and 26 are respectively hingedly coupled at opposite ends of major panel 14 by means of fold lines 27 and 28. Similarly, two rectangular major closure flaps 29 and 30 are hingedly coupled at opposite ends of major panel 15 along fold lines 31 and 32.

Minor panel 16 has two minor closure flaps 34 and 35 hingedly coupled at opposite ends along fold lines 36 and 37 and minor panel 17 has minor closure flaps 38 and 39 hingedly coupled at opposite ends along fold lines 40 and 41.

As seen in FIG. 2, the major closure flaps 29 and 30 associated with major panel 15 have adhesive areas 42 and 43 thereon to close the ends of the carton securing the contents therein.

The spout 12 in accordance with the present invention as seenn in FIGS. 1-4 comprises a main spout member 45 and a secondary spout member 46. These spout members are located in minor panel 16 as seen in FIGS. 1-4, although they could be located in any desired panel.

The main spout member 45 is defined by a first fold line, which is fold line 36, first and second tear-away members 48 and 49 extending from the first fold line 36, and a third tear-away member 50 interconnecting the first and second tear-away members.

The secondary spout member 46 is defined by a second fold line 52 formed in panel 16 and the third tear-away member 50.

These three tear-away members are formed by a plurality of cut lines extending a depth into the panel 16 less than the thickness of that panel, so that they do not completely penetrate the panel. Some of the cut lines are in the exterior surface of the blank while others are in the interior surface of the blank.

In particular, as seen in FIG. 1, there are first and second cut lines 54 and 55 extending and tapering inwardly from the first fold line 36, formed in the exterior surface of panel 16 and extending a depth into the panel less than the thickness of the panel.

Third and fourth cut lines 56 and 57 are substantially colinear, extend respectively from the ends of the first and second cut lines 54 and 55, are formed in the exterior surface of the panel and extend a depth into the panel less than the thickness of the panel.

These third and fourth cut lines 56 and 57 are interconnected at their ends by a semi-circular fifth cut line 58 which is also formed in the exterior surface of the panel and extends a depth into the panel less than the thickness thereof.

The second fold line 52 extends between the ends of and is substantially colinear with the third and fourth cut lines 56 and 57, as best seen in FIG. 3. This second fold line 52 also interconnects the ends of the semi-circular fifth cut line 58.

Referring now to FIGS. 2 and 4 showing the interior surface of the blank 10, a sixth semi-circular cut line 59 is formed in the interior surface of the panel, extends a depth into the panel less than the thickness thereof and extends from a location adjacent the third cut line 56 on the exterior surface of the blank to a location adjacent the fourth cut line 57 on the exterior surface and is concentrically spaced from the fifth semi-circular cut line 58 towards the first fold line 36.

Seventh and eighth cut lines 60 and 61 are formed in the interior surface of the panel, extend a depth into the panel less than the thickness of the panel and extend from the first fold line 36 into an intersection with the sixth semi-circular cut line 59. These seventh and eighth cut lines are respectively spaced from and are between the first and second cut lines 54 and 55. As seen in FIGS. 3 and 4, the first and second cut lines 54 and 55 taper inwardly from the first fold line 36, as do the seventh and eighth cut lines 60 and 61. The first and seventh cut lines 54 and 60 are substantially parallel and the second and eighth cut lines are also substantially parallel. The fifth and sixth substantially semi-circular cut lines are substantially concentric.

As is evident from FIG. 3, the first tear-away member 48 is that portion of panel 16 between the two spaced first and eighth cut lines 54 and 61, the first cut line being formed in the exterior surface of the panel and the eighth cut line being formed in the interior surface of the panel.

Similarly, the second tear-away member 49 is that portion of the panel 16 between the two spaced second and seventh cut lines 55 and 60, similarly formed respectively in the exterior and interior surfaces of the panel 16.

In addition, the third tear-away member 50 is that portion of the panel 16 between the semi-circular fifth and sixth cut lines 58 and 59 formed respectively on the exterior and interior surfaces of the panel 16.

Figure 5:
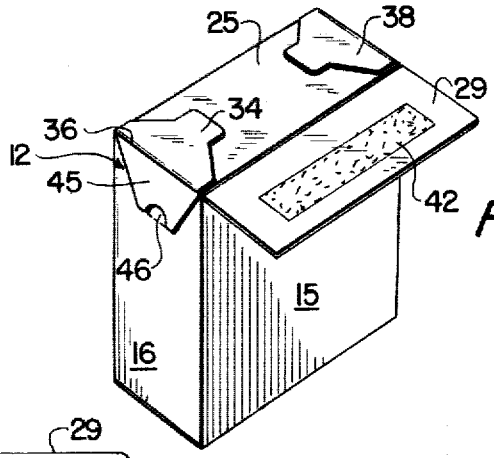
FIG. 5 is a perspective view of a substantially completed carton in accordance with the present invention indicating a preferred sequence of folding the closure flaps to close an end thereof including first folding one of the major closure flaps, then folding the two minor closure flaps and finally folding the other major closure flap.
Figure 7:
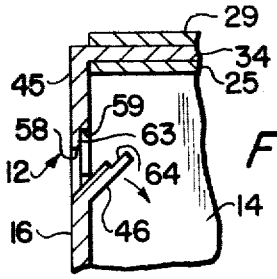
FIG. 7 is a cross-sectional view taken along lines 7—7 in FIG. 6.
Figure 9:
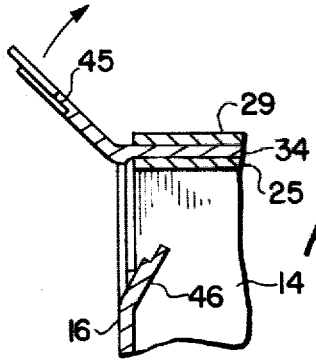
FIG. 9 is a cross-sectional view taken along lines 9—9 in FIG. 8.

Referring now to FIG. 5, the carton formed from the blank 10 is shown in the substantially complete set up condition folded about the various fold lines seen in FIGS. 1 and 2 with the major closure flap 29 about to be closed. It is preferable as seen in FIG. 5 for the major closure flap 25 to be first closed and then the minor closure flaps 34 and 35 folded thereon, with the other major closure flap 29 completing the closure so that the major closure flap 25 is the lowest flap inside the carton adjacent spout 12, as seen in FIGS. 7, 9 and 11. This provides for a free flowing channel for the contents to be poured out of the opened spout 12 which might be prevented were minor closure flap 34 the lowermost folded closure flap.

Figure 6:
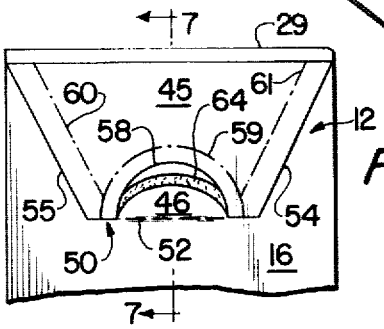
FIG. 6 is a fragmentary, enlarged side elevational view of the spout in the carton shown in FIG. 5 with the secondary spout member having been pushed into the carton and with the remaining closure flap closed.

As seen in FIGS. 6 and 7, the secondary spout member 46 has been pushed inwardly into the interior of the carton without movement of the main spout member. This is accomplished by a tearing of the third tear-away member 50 and a pivoting of the secondary spout member 46 about the second fold line 52. As seen in FIG. 6, this tearing away is provided by a complete severance of the panel 16 material along the two semi-circular fifth and sixth cut lines 58 and 59 and a tearing of the portion of panel 16 between these two cut lines. As seen best in FIG. 7, this severance and tearing leaves a torn area 63 on the main spout member 49 between cut lines 58 and 59 and a corresponding torn area 64 on the secondary spout member 46.

As seen in FIGS. 8 and 9, in order to open the spout 12 fully, the main spout member 45 is pulled outwardly from the carton and pivoted about fold line 36. In order to accomplish this, the first and second tear-away members 48 and 49 are torn so that the various cut lines forming these tear-away members are completely severed and the portion of the panel therebetween is torn apart. This leaves a torn area 66 on the inside of the main spout member 45 and two corresponding torn areas 66 and 67 which remain with panel 16.

As seen in FIG. 8, an orifice 70 is defined by the area vacated by the main spout member 45 when it is pivoted outwardly and upwardly. This orifice 70 allows the contents of the carbon to be easily dispensed.

In order to reclose the spout 12 surrounding and forming orifice 70, the secondary spout member 46 is pivoted outwardly from a position shown in FIG. 9 so that the main spout member 45 can be pivoted downwardly and inwardly filling orifice 70. This is shown in FIGS. 10 and 11 with the main spout member 45 closing the orifice 70. In order to maintain the main spout member 45 in this reclosed position, the secondary spout member 46 is released from its outward pivoted position and pushed against the main spout member. Because of the memory of the thin, foldable paperboard, the secondary spout member 46 stays in the position adjacent and contacting the outside of the main spout member 45, thereby keeping the latter closed.

While one advantageous embodiment has been chosen to illustrate the invention, it will be understood by those skilled in the art that various changes and modifications can be made therein without departing from the scope of the invention as defined in the appended claims. For instance, the cut lines forming the first and second tear-away members need not inwardly taper as shown in FIGS. 1–4, but could be substantially perpendicular to fold line 36. in addition, cut lines 58 and 59 could be formed as a plurality of straight lines rather than semi-circular. Also, the first and second tear-away members could be merely weakened lines such as perforated cut lines, each comprising only one such line.

What is claimed is:

1. A carton formed of paperboard having a reclosable spout comprising:

a plurality of panels hingedly coupled along fold lines and arranged as a closed tubular body, one of said panels including a main spout member and a secondary spout member, said main spout member being defined by a first fold line, first and second tear-away members extending from said first fold line and a third tear-away member interconnecting said first and second tear-away members, said secondary spout member being defined by a second fold line and said third tear-away member, said third tear-away member being formed from a pair of spaced cut lines, one of said cut lines being formed on the exterior surface of said panel and the other of said cut lines being formed on the interior surface of said panel, each of said cut lines extending a depth into said panel less than the thickness of said panel.

2. A carton according to claim 1, wherein said first tear-away member is formed from another pair of spaced cut lines formed respectively on the exterior and interior surfaces of said panel and extending a depth into said panel less than the thickness of said panel.

3. A carton according to claim 1, wherein said second tear-away member is formed from another pair of spaced cut lines formed respectively on the exterior and interior surfaces of said panel and extending a depth into said panel less than the thickness of said panel.

4. A carton according to claim 1, wherein said pair of cut lines forming said third tear-away member are curvilinear.

5. A carton according to claim 1, wherein said pair of cut lines forming said third tear-away member are substantially semi-circular.

6. A carton according to claim 1, wherein said first and second tear-away members taper inwardly from said first fold line.

7. A blank for a paperboard carton having a reclosable spout comprising:

a plurality of panels hingedly coupled in series along fold lines, one of said panels including a first fold line first and second cut lines extending from said first fold line and formed in the exterior surface of said panel and extending a depth into said panel less than the thickness of said panel, third and fourth cut lines extending from said first and second cut lines and formed in the exterior surface of said panel and extending a depth into said panel less than the thickness of said panel, a fifth cut line interconnecting said third and fourth cut lines and formed in the exterior surface of said panel and extending a depth into said panel less than the thickness of said panel, a second fold line extending between said third and fourth cut lines, a sixth cut line formed in the interior surface of said panel and extending a depth into said panel less than the thickness of said panel, said sixth cut line extending from a location adjacent said third cut line to a location adjacent said fourth cut line and being spaced from said fifth cut line, and seventh and eighth cut lines formed in the interior surface of said panel and extending a depth into said panel less than the thickness of said panel, said seventh and eighth cut lines extending from said first fold line into an intersection with said sixth cut line and being spaced from said first and second cut lines.

8. A blank according to claim 7, wherein said first and second cut lines taper inwardly from said first fold line.

9. A blank according to claim 7, wherein said seventh and eighth cut lines taper inwardly from said first fold line.

10. A blank according to claim 7, wherein said fifth cut line is curvilinear.

11. A blank according to claim 7, wherein said sixth cut line is curvilinear.

12. A blank according to claim 7, wherein said third and fourth cut lines are substantially colinear.

13. A blank for a paperboard carton having a reclosable spout comprising:

a plurality of panels hingedly coupled in series along fold lines, one of said panels including a first fold line, first and second cut lines extending from said first fold line, third and fourth cut lines extending from said first and second cut lines and formed in the exterior surface of said panel and extending a depth into said panel less than the thickness of said panel, a fifth cut line interconnecting said third and fourth cut lines and formed in the exterior surface of said panel and extending a depth into said panel less than the thickness of said panel, a second fold line extending between said third and fourth cut lines, and a sixth cut line formed in the interior surface of said panel and extending a depth into said panel less than the thickness of said panel, said sixth cut line extending from a location adjacent said third cut line to a location adjacent said fourth cut line and being spaced from said fifth cut line.

14. A blank according to claim 13, wherein said first and second cut lines extend a depth into said panel less than the thickness of said panel.

* * * * *